US006659278B1

(12) United States Patent
Velliquette

(10) Patent No.: US 6,659,278 B1
(45) Date of Patent: Dec. 9, 2003

(54) RETAIL DISPLAY HANG TAG DEVICE

(76) Inventor: Stephen P. Velliquette, 4411 Bee Ridge Rd., #593, Sarasota, FL (US) 34233

( * ) Notice: Subject to any disclaimer, the term of this patent is extended or adjusted under 35 U.S.C. 154(b) by 86 days.

(21) Appl. No.: 09/971,169

(22) Filed: Oct. 4, 2001

(51) Int. Cl.[7] ..... B65D 73/00
(52) U.S. Cl. ..... 206/488; 206/478; 206/462; 206/806
(58) Field of Search ..... 206/461, 462, 206/464, 806, 372, 373, 376, 349, 483, 478, 479, 486, 160, 476, 488; 211/60.1; 220/480, 75.1

(56) References Cited

U.S. PATENT DOCUMENTS

| | | | | | |
|---|---|---|---|---|---|
| 4,247,003 | A | * | 1/1981 | Jones | 206/486 |
| 5,048,677 | A | * | 9/1991 | Pedracine | 206/573 |
| 5,425,519 | A | * | 6/1995 | Budert | 206/378 |
| 5,477,964 | A | * | 12/1995 | Hart | 206/483 |
| 5,641,233 | A | | 6/1997 | Wilson | |
| 5,857,796 | A | | 1/1999 | Waldmann | |

FOREIGN PATENT DOCUMENTS

GB 2269577 A * 2/1994 ..... B65D/73/00

* cited by examiner

*Primary Examiner*—Mickey Yu
*Assistant Examiner*—Greg Pickett
(74) *Attorney, Agent, or Firm*—Charles J. Prescott

(57) ABSTRACT

A retail display hang tag device for supportively displaying a fluid applicator of the type having a container and a fluid dispensing closure with a protective cap. The hang tag includes an elongated panel having an upper portion, a lower portion and a central portion extending therebetween. The upper portion has an aperture sized for supportive engagement with a retail display hanger or hook. A second aperture of the lower portion closely fits over the neck of the container and is flexibly bendable about the first line of weakness. The central portion includes a ring which is bendably deformable about a second transverse line of weakness which is parallel to the first line of weakness. The ring snugly fits over the cap as it is deformed out of the plane of the device about the second line of weakness. The hang tag is attachable to the fluid applicator with the cap within the third aperture and the neck within the second aperture with the lower portion and the ring in their in-use position. A prong formed at the lower end of the central portion engages with grooves in the cap for best retail viewing.

3 Claims, 3 Drawing Sheets

RETAIL DISPLAY HANG TAG DEVICE

BACKGROUND OF THE INVENTION

1. Scope of Invention

This invention relates generally to hanging devices for display, and more particularly to a retail display hang tag device for supporting and displaying a fluid dispenser of the type having a container filled or fillable with a fluid and a dispensing closure with a removable protective cap.

2. Prior Art

The retail display of products is a substantial factor in marketing success. Where products can be easily viewed from an economical hanging arrangement for customers to quickly see and discern the usefulness or utility of the product being displayed, sales will typically be greater.

The displaying of a fluid applicator of the type shown in U.S. Pat. Nos. 5,641,233 and 5,857,796 either filled or fillable with a fluid such as a tile grout sealant is currently unimaginative and ineffective. Typically, such fluid containers are stacked upright on a shelf or placed into boxes or packages for similar stacking arrangements. Because of this retail stacking limitation, a potential customer will have more difficulty in discerning the contents and utility of such a product.

It is also likely that a casual potential customer browsing shelves or even a customer aware of and searching for the product being sought will actually have difficulty finding the location of the product being sought when it is either stacked by itself or in packaging or containers. Retail items which can be easily hung from display wires or hooks and are easily viewable by retail customers, will almost certainly enjoy better marketing success. Moreover, maintaining the dispensing closure tightly sealed to the container and keeping the removable cap covering the dispensing portion of the closure in place is not offered by current hanging display methods.

The present invention provides a retail display hang tag device for supportively displaying a fluid applicator of the type having a container which is filled or fillable with a fluid to be dispensed from a dispensing closure with a removable protective cap. The device is also easily and economically manufacturable as a unit in a generally flat configuration with bendable portions for attachment to the fluid applicator which not only supports the fluid applicator in an upright orientation attached to a conventional display hanger or hook, but also prevents the inadvertent removal of the dispensing closure's protective cap from the dispensing closure. The preferred embodiment further contains a prong for preventing inadvertent rotation of the container and its display indicia from a full forwardly facing orientation when the hang tag device is placed onto hanger hooks.

BRIEF SUMMARY OF THE INVENTION

This invention is directed to a retail display hang tag device for supportively displaying a fluid applicator of the type having a container and a fluid dispensing closure with a protective cap. The hang tag includes an elongated panel having an upper portion, a lower portion and a central portion extending therebetween. The upper portion has an aperture sized for supportive engagement with a retail display hanger or hook. A second aperture of the lower portion closely fits over the neck of the container and is flexibly bendable about the first line of weakness. The central portion includes a ring which is bendably deformable about a second transverse line of weakness which is parallel to the first line of weakness. The ring snugly fits over the cap as it is deformed out of the plane of the device about the second line of weakness. The hang tag is attachable to the fluid applicator with the cap within the third aperture and the neck within the second aperture with the lower portion and the ring in their in-use position. A prong formed at the lower end of the central portion engages with grooves in the cap for best retail viewing.

It is therefore an object of this invention to provide a retail display hang tag device which will supportively display a fluid applicator of the type having a container filled with, or fillable with, a fluid for dispensing through a dispensing closure with a removable protective cap.

It is another object of this invention to provide an economical retail display hang tag device which is readily attachable to a fluid applicator and which also maintains the important printed retail indicia attached to the hanger in a forwardly facing easily readable orientation.

In accordance with these and other objects which will become apparent hereinafter, the instant invention will now be described with reference to the accompanying drawings.

DETAILED DESCRIPTION OF THE INVENTION

Figure 1:
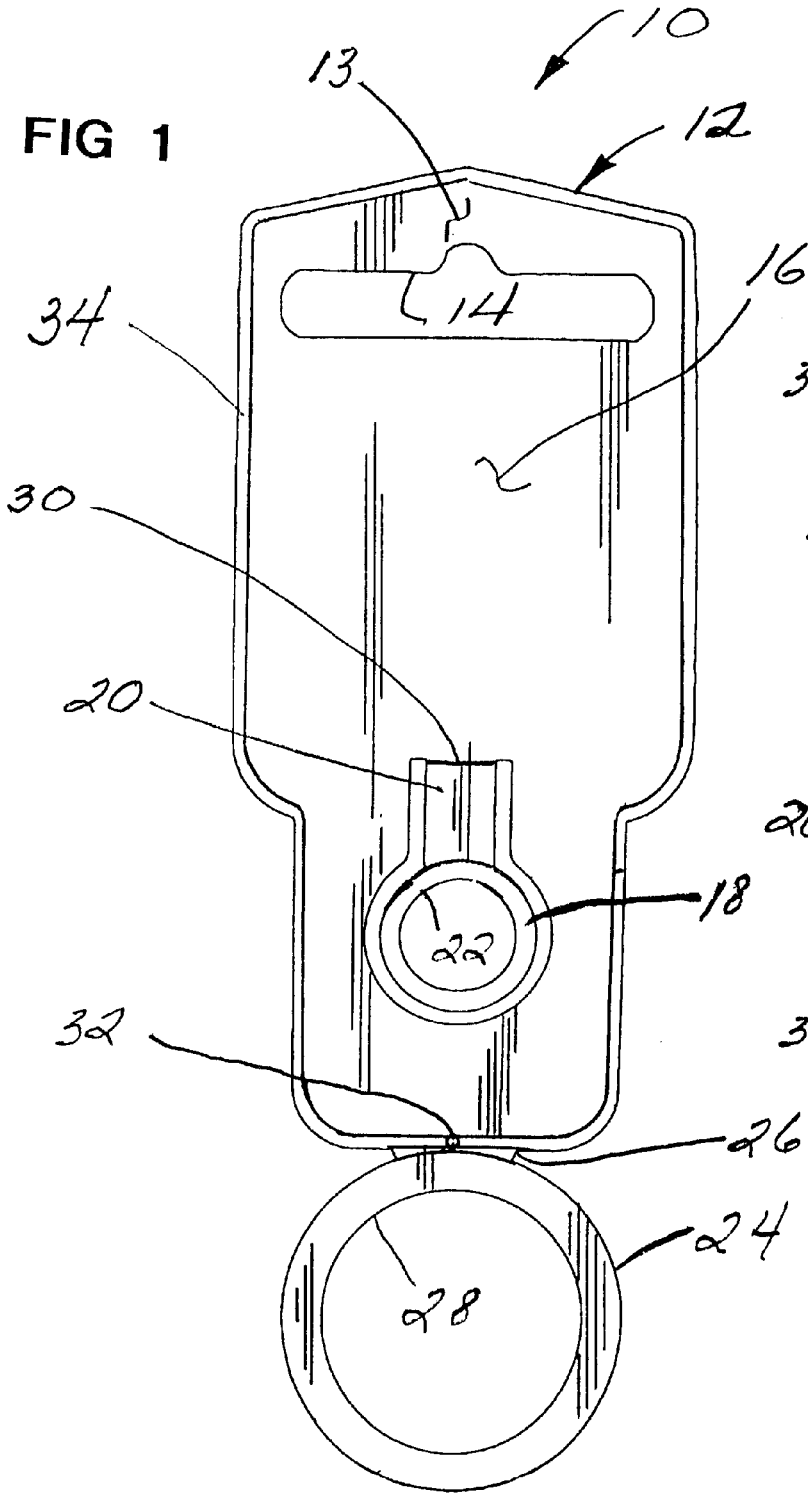
FIG. 1 is a front elevation view of the invention.
Figure 2:
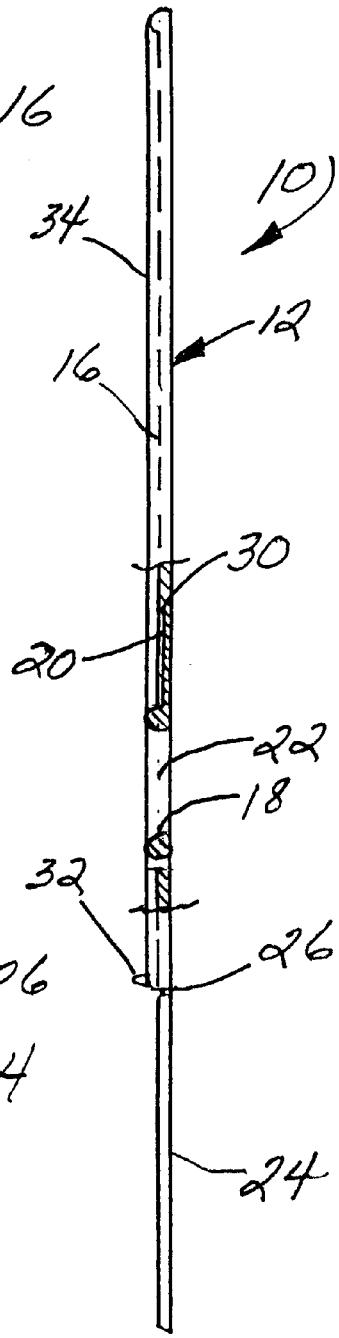
FIG. 2 is a side elevation partially broken view of the invention shown in FIG. 1.

Referring now to the drawings and particularly to FIGS. 1 and 2, the invention is there shown generally at numeral 10 and includes an elongated generally flat molded plastic panel 12 formed as a single unit. The panel 12 is generally rectangular in configuration and defines an upper portion 13 having a first aperture 14 sized to supportively receive a conventional display hook or hanger shown in phantom by example at H in FIG. 3. A strengthening rib or bead 34 extends around the perimeter of the central and upper portions 16 and 13.

The central portion 16 of the panel 12 provides a surface for additional retail display indicia and also includes a ring 18 formed therethrough, the ring 18 being attached to the central portion 16 by tab 20 which is thinner than the central portion 16, the discontinuity in material thickness forming a line of weakness 30 which delineates the central portion 16 from tab 20 attached to the ring 18. Ring 18 defines a second aperture 22 which is sized to snugly fit over a removable protective cap F shown in FIG. 3 and better described herebelow. The cap F is normally held in its protective position over the fluid dispensing portion such as bristles (not shown) of fluid dispensing closure G by friction engagement on valve portion E.

Figures 3, 3A:
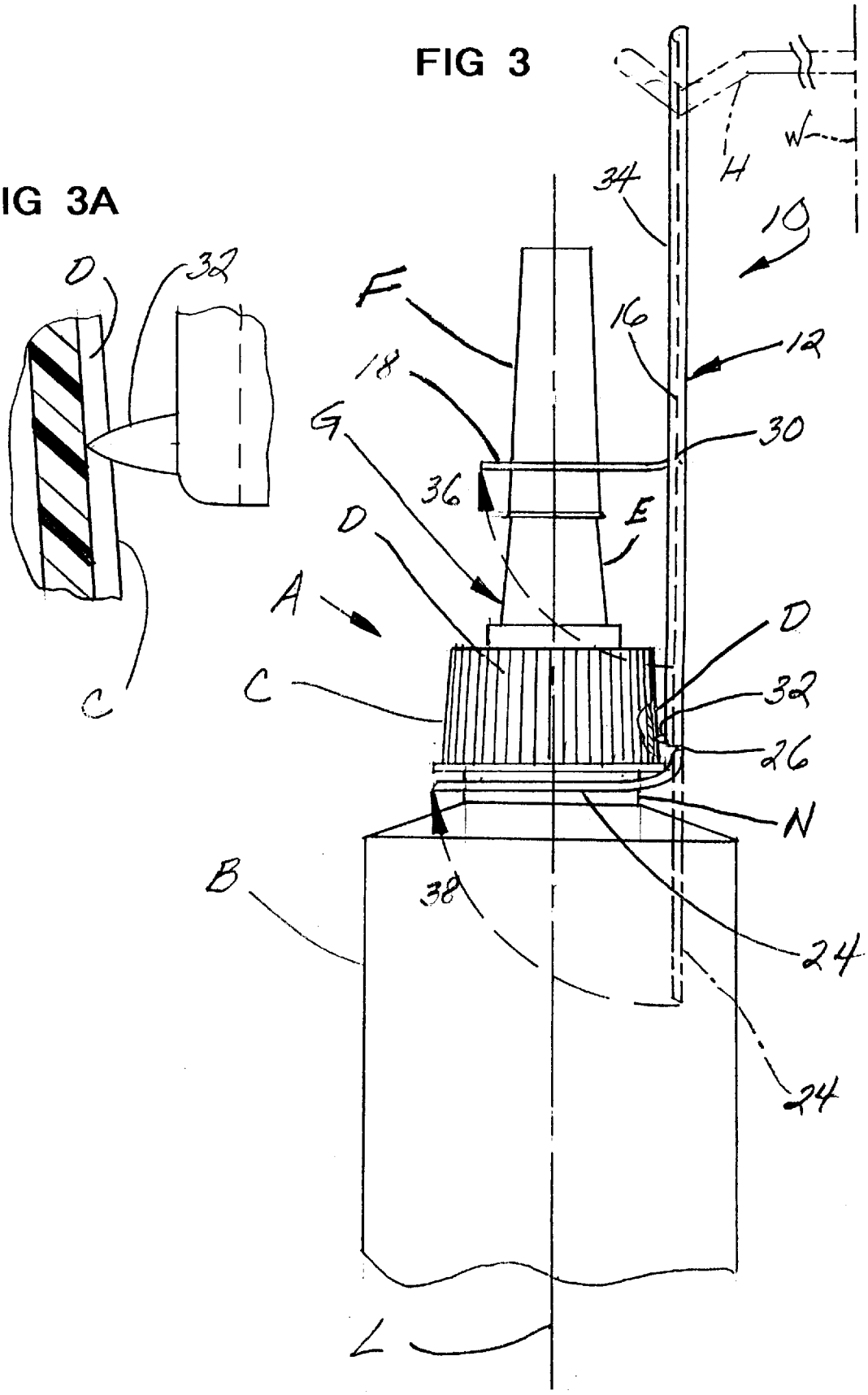
FIG. 3 is a side elevation view of the invention of FIG. 1 in its in-use position attached to and supporting a fluid applicator.
FIG. 3A is an enlargement of the anti-rotation interengagement between the device and the base of the fluid applicator.
Figure 4:
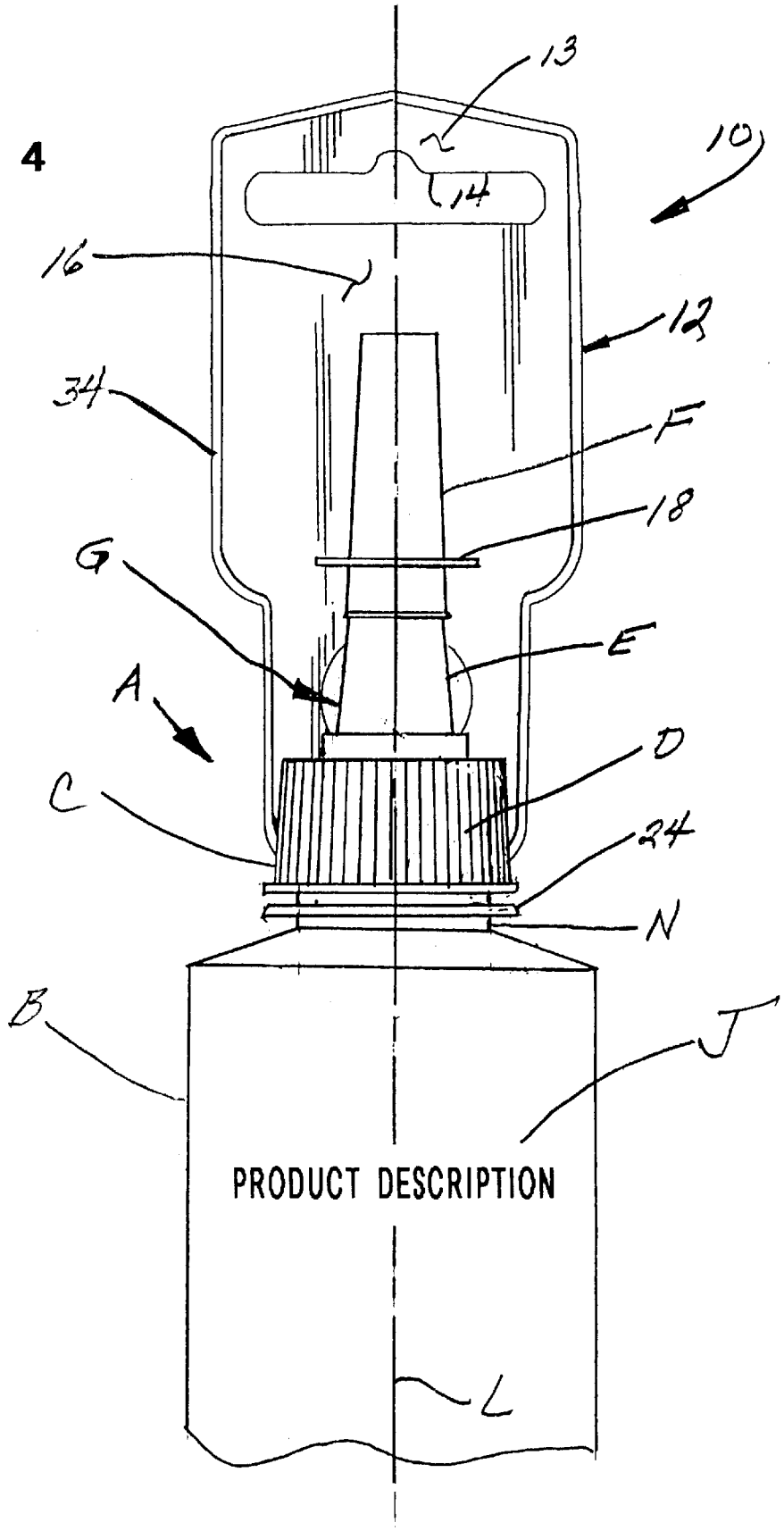
FIG. 4 is a front elevation view of FIG. 3.

A lower portion 24 of the panel 12 is hingedly connected along a transverse line of weakness 26, the lower portion 24 defining a second aperture 28 formed therethrough which is sized to fit around the neck N of a container B as seen in FIGS. 3 and 4. Both of the lines of weakness 30 and 26 are parallel to one another and oriented transversely to a length of panel 12.

The device 10 also includes a molded pointed prong 32 which is positioned along a longitudinal centerline of panel 12 at the lower end of the central portion 16 and immediately adjacent the line of weakness 26. The purpose and function of the prong 26 will be described herebelow.

Referring additionally to FIGS. 3, 3A and 4, the device 10 is structured for supportive interengagement with, and detail display of, a fluid applicator shown generally at A which includes a container B having an open upper neck portion N which is threadably engagable into a base C of a central valved portion E of the dispensing closure G. A removable tapered cap F fits atop and is frictionally held on the brush valve portion E to protectively conceal the fluid dispensing portion (not shown) of the fluid applicator A.

By pivoting the ring 18 of the central portion 16 in the direction of arrow 36 and positioning it snugly over the cap F, and by pivoting the lower portion 24 in the direction of arrow 38 and positioning it over the neck N of the bottle B and threadably engaging the base C onto the neck N as shown in FIGS. 3 and 4, the device 10 will supportively display the printed indicia or product description J printed onto the front surface of the container B when hung from a hanger H attached to a wall W or other vertical surface through aperture 14.

Prong 32 as best seen in FIG. 3A, automatically engages into one of the longitudinal grooves D typically formed into the base C for greater tightening of the base C onto the threaded neck N of the bottle B. By this interengagement of prong 32 into one of the grooves D, proper orientation of the product description information J will be maintained in an outwardly facing position for better consumer viewing when the device 10 supportively retains the fluid applicator A on a hanger H. Should reorientation of the bottle B be necessary with respect to the device 10 before being hung onto a hanger H, the prong 32 will resiliently deflect with respect to the grooves D to allow for easy readjustment to achieve a proper rotational orientation of the bottle B before hanging the entire arrangement for display as seen in FIGS. 3 and 4.

Sequence of Attachment

The device 10 is manufactured of molded plastic in the flat as best seen in FIGS. 1 and 2. To supportively attach the fluid applicator A (either with or without fluid within the container B), the base C is removed from threaded engagement with neck N and the cap F is then inserted into the ring 18 after it has been deformably moved into a generally orthogonal orientation in the direction of arrow 36 about the hinge or line of weakness 30 with respect to the central portion 16. Thereafter, the neck N of bottle B is inserted through the aperture 28 of the lower portion 24 after or as the lower portion 24 has been deflected or deformed in the direction of arrow 38 also into a generally orthogonal orientation with respect to the main portion 16. The final assembly attachment step is to again threadably engage the neck N of the bottle B into its base C with the lower portion 24 positioned around the base of the neck N. Note that, when ring 18 and lower portion 24 are deformed into the in-use position orthogonal to the central portion 16, the centers of apertures 22 and 28 are concentric with the longitudinal axis L of the fluid applicator A and its container B as seen in FIGS. 3 and 4. Note further that the longitudinal spacing between the apertures 22 and 28 is established to maintain a resilient retaining force exerted on cap F. Only by again removing the base C from the container B may the device 10 be disengaged from the fluid applicator.

As will be now more clearly understood, prong 32 being positioned immediately adjacent the line of weakness 26, will automatically engage into one of the grooves D of base C due to the close proximity between prong 32 and the line of weakness 26 as the lower portion 24 is deformed in the direction of arrow 38 in FIG. 3.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A retail display hang tag device for supportively displaying a fluid applicator of the type having a container filled with a fluid, a removable fluid dispensing closure including closely spaced longitudinal grasping grooves and a removable protective cap, said hang tag comprising:

an elongated generally flat panel molded as a unit and having an upper portion, a lower portion and a central portion extending therebetween;

said upper portion having a first aperture formed therethrough sized to fit over and receive support from a display hanger or hook;

said lower portion separated from said central portion by a first transverse line of weakness and having a second aperture formed therethrough sized to closely fit over and around a neck of an open upper end of the container before the fluid dispensing closure is placed into threaded engagement over the open upper end of the container;

said lower portion being retained in position around the neck when the fluid dispensing closure is threadably attached to the open upper end of the container;

said lower portion being flexibly bendable about said first line of weakness into an in-use position somewhat orthogonal to said central portion;

said central portion having a ring formed therewith, said ring separated from said central portion by a second transverse line of weakness and defining a third aperture sized to snugly fit over and to retain the cap in place attached to the fluid dispensing closure;

said ring being flexibly bendable about said second line of weakness into an in-use position somewhat orthogonal to said central portion and generally parallel to said lower portion;

said hang tag being attachable to supportively display the fluid applicator by positioning the cap into said third aperture and the neck of the container into said second aperture with said lower portion and said ring being in the in-use position and the container and the fluid dispensing closure are attached to one another;

single prong formed having a pointed tip and extending orthogonally from a lower end of said central portion, said prong being resiliently urged into engagement with one of the grooves by positioning said second aperture over the neck when said device is supportively attached to the fluid applicator to maintain a preselected viewable orientation of printed indicia on an outwardly facing surface of the container;

said prong being resiliently deflectable when engaged into one of the grooves allowing repositioning of said prong into another groove to achieve another selected rotational reorientation of the printed indicia.

2. A retail display hang tag device for supportively displaying a fluid applicator of the type having a container filled or fillable with a fluid and a removable fluid dispensing closure including closely spaced longitudinal grasping grooves with a removable protective cap, said hang tag comprising:

an elongated generally flat panel molded as a unit and having an upper portion, a lower portion and a central portion extending therebetween;

said upper portion having a first aperture formed therethrough sized to fit over and receive support from a retail display hanger or hook;

said lower portion separated from said central portion by a first transverse line of weakness which forms a first bendable hinge and having a second aperture formed therethrough sized to closely fit over and around a neck of an open upper end of the container before the fluid dispensing closure is placed into threaded engagement over the open upper end of the container thus securing said lower portion in position around the neck of the container;

said central portion having a ring formed therewith, said ring separated from said central portion by a second transverse line of weakness which forms a second bendable hinge and defining a third aperture sized to snugly fit over and to keep said cap in place atop the fluid dispensing closure;

said lower portion and said ring each being flexibly bendable about said first and second lines of weakness, respectively, into an in-use position somewhat orthogonally extending in the same direction from said central portion;

said hang tag being attachable to supportively display the fluid applicator for retail sale by positioning the cap into said third aperture and the neck of the container into said second aperture with said lower portion and said ring being in the in-use position and the container and the fluid dispensing closure attached to one another;

a single prong formed having a pointed tip and extending orthogonally from a lower end of said central portion, said prong being urged into engagement with one of the grooves by positioning said second aperture over the neck when said device is supportively attached to the fluid applicator to maintain a preselected viewable orientation of printed indicia on an outwardly facing surface of the container;

said prong being resiliently deflectable when engaged into one of the grooves allowing repositioning of said prong into another groove to achieve another selected rotational reorientation of the printed indicia.

3. A retail display hang tag device for supportively displaying a fluid applicator of the type having a container filled or fillable with a fluid and a fluid dispensing closure including closely spaced longitudinal grasping grooves with a removable protective cap, said hang tag consisting essentially of:

an elongated generally flat panel molded as a unit and having an upper portion, a lower portion and a central portion extending therebetween;

said upper portion having a first aperture formed therethrough sized to fit over and receive support from a retail display hanger or hook;

said lower portion separated from said central portion by a first transverse line of weakness which forms a first bendable hinge and having a second aperture formed therethrough sized to closely fit over and around a neck of an open upper end of the container before the fluid dispensing closure is placed into threaded engagement over the open upper end of the container thus securing said lower portion in position around the neck of the container;

said central portion having a ring formed therewith, said ring separated from said central portion by a second transverse line of weakness which forms a second bendable hinge and defining a third aperture sized to snugly fit over the and keep cap in place atop the fluid dispensing closure;

said lower portion and said ring each being flexibly bendable about said first and second lines of weakness, respectively, into an in-use position somewhat orthogonally extending in the same direction from said central portion;

said hang tag being attachable to supportively display the fluid applicator for retail sale by positioning the cap into said third aperture and the neck of the container into said second aperture with said lower portion and said ring being in the in-use position and the container and the fluid dispensing closure attached to one another;

a single prong formed having a pointed tip and extending orthogonally from a lower end of said central portion, said prong being urged into engagement with one of the grooves by positioning said second aperture over the neck when said device is supportively attached to the fluid applicator to maintain a preselected viewable orientation of printed indicia on an outwardly facing surface of the container;

said prong being resiliently deflectable when engaged into one of the grooves allowing repositioning of said prong into another groove to achieve another selected rotational reorientation of the printed indicia.

* * * * *